US008752399B2

(12) United States Patent
Lingrey et al.

(10) Patent No.: US 8,752,399 B2
(45) Date of Patent: Jun. 17, 2014

(54) ROOM AIR CONDITIONER AND/OR HEATER

(75) Inventors: David J. Lingrey, San Antonio, TX (US); Kevin L. Eicher, Seguin, TX (US); Geethakrishnan Vasudevan, San Antonio, TX (US); David John Sayler, Portland, OR (US)

(73) Assignee: Friedrich Air Conditioning Co., Ltd., San Antonio, TX (US)

( * ) Notice: Subject to any disclaimer, the term of this patent is extended or adjusted under 35 U.S.C. 154(b) by 684 days.

(21) Appl. No.: 12/692,102

(22) Filed: Jan. 22, 2010

(65) Prior Publication Data

US 2011/0120155 A1 May 26, 2011

Related U.S. Application Data

(63) Continuation-in-part of application No. 29/350,863, filed on Nov. 24, 2009, now Pat. No. Des. 616,084.

(51) Int. Cl.
*F24F 7/013* (2006.01)
*F25D 17/06* (2006.01)

(52) U.S. Cl.
USPC ..... 62/427; 62/412; 454/202; 454/224

(58) Field of Classification Search
CPC ..... F24F 13/072; F24F 13/081; F24F 13/082; F24F 13/084; F24F 13/1413; F24F 13/1426; F24F 13/15; F24F 13/20; F24F 13/12; F24F 2221/26
USPC ..... 62/262, 263, 404, 408, 412, 427; 454/201, 202, 224
See application file for complete search history.

(56) References Cited

U.S. PATENT DOCUMENTS

| | | | | |
|---|---|---|---|---|
| 3,577,905 | A * | 5/1971 | Nussdorfer et al. | 454/202 |
| 3,911,693 | A | 10/1975 | Seigler et al. | |
| 3,982,405 | A | 9/1976 | Seigler et al. | |
| 4,176,525 | A | 12/1979 | Tucker et al. | |
| 4,550,770 | A * | 11/1985 | Nussdorfer et al. | 165/242 |
| D284,305 | S | 6/1986 | Lapychak et al. | |
| 4,616,559 | A * | 10/1986 | Barlow | 454/298 |
| 4,633,770 | A | 1/1987 | Taylor et al. | |
| 4,818,462 | A | 4/1989 | Murano | |

(Continued)

FOREIGN PATENT DOCUMENTS

| | | |
|---|---|---|
| CA | 2031415 | 4/1994 |
| CA | 2031426 | 4/1994 |
| CA | 2040223 | 10/1995 |
| CA | 2054308 | 12/1995 |

*Primary Examiner* — Mohammad M Ali
*Assistant Examiner* — Christopher R Zerphey
(74) *Attorney, Agent, or Firm* — Gunn, Lee & Cave, P.C.

(57) ABSTRACT

A room air conditioner and/or heat pump is shown having a compressor, indoor coil, accumulator, expansion device and reversing valve for changing between a cooling cycle and a heating cycle. Intake louvers direct return air over the entire indoor coil for maximum heat transfer. Discharge louvers are curved upward to prevent short cycling while still being totally adjustable, up and down, right and left. Adjustment posts are anchored to a clip and are adjustable for right or left discharge of air and up or down discharge. Single handles control both the right or left discharge through a rear set of louvers and up or down discharge through a front set of louvers. A no circulation area prevents short cycling and curved edges prevent turbulence in air flow through louvers.

2 Claims, 12 Drawing Sheets

(56) References Cited

U.S. PATENT DOCUMENTS

| | | | | |
|---|---|---|---|---|
| D310,410 | S | 9/1990 | Lapychak et al. | |
| D310,411 | S | 9/1990 | Lapychak et al. | |
| 5,038,577 | A | 8/1991 | Stanford | |
| 5,060,720 | A | 10/1991 | Wollaber et al. | |
| 5,094,089 | A | 3/1992 | Lail | |
| 5,140,830 | A | 8/1992 | Sawyer | |
| 5,152,336 | A | 10/1992 | Wollaber et al. | |
| D337,816 | S | 7/1993 | Hogan | |
| D342,781 | S | 12/1993 | Thompson et al. | |
| 5,271,242 | A | 12/1993 | Addington | |
| 5,272,889 | A | 12/1993 | Harris | |
| 5,335,721 | A * | 8/1994 | Wollaber et al. | 165/122 |
| 5,393,262 | A * | 2/1995 | Hashimoto et al. | 454/155 |
| 5,622,058 | A | 4/1997 | Ramakrishnan et al. | |
| 5,732,565 | A | 3/1998 | Ramakrishnan et al. | |
| 6,022,270 | A * | 2/2000 | Bascaran et al. | 454/201 |
| 6,059,654 | A * | 5/2000 | Kim | 454/202 |
| 6,065,296 | A | 5/2000 | Feger | |
| 7,229,582 | B2 * | 6/2007 | Yamazaki et al. | 264/242 |
| D616,084 | S | 5/2010 | Lingrey et al. | |
| 7,757,722 | B1 * | 7/2010 | Lesch et al. | 138/149 |
| 2004/0038643 | A1 * | 2/2004 | Katagiri et al. | 454/314 |
| 2004/0050077 | A1 * | 3/2004 | Kasai et al. | 62/186 |
| 2005/0056037 | A1 * | 3/2005 | Park et al. | 62/262 |
| 2005/0097915 | A1 * | 5/2005 | Joo et al. | 62/408 |
| 2006/0150463 | A1 * | 7/2006 | Kim et al. | 40/725 |
| 2006/0201042 | A1 * | 9/2006 | Kim et al. | 40/725 |
| 2008/0168722 | A1 * | 7/2008 | Hendricks | 52/198 |

* cited by examiner

ROOM AIR CONDITIONER AND/OR HEATER

CROSS-REFERENCES TO RELATED APPLICATIONS

The present invention is a continuation-in-part of U.S. Design patent application Ser. No. 29/350,863, filed on Nov. 24, 2009.

BACKGROUND OF THE INVENTION

The present invention relates to room air conditioners that can be used for cooling and/or heating and, more particularly, to the airflow there through.

BRIEF DESCRIPTION OF THE PRIOR ART

Air conditioning can refer to any form of cooling, heating, ventilation, dehumidification, disinfection, or anything else that modifies the condition of air. Most people think of the terms "air conditioner" as referring to the cooling of air. Various forms of air conditioning have gone back as far as the second century in the Han Dynasty. British Scientist and Inventor Michael Faraday discovered that ammonia could be compressed into a liquid and allowed to evaporate to give a cooling effect. One of the earliest electric air conditioning units was invented by Willis Havilan Carrier, after whom the large heating/cooling company of Carrier Corporation is named.

Because ammonia was a toxic flammable gas, other products such as chlorofluorocarbon (CFC) were developed with a brand being marketed by DuPont Corporation being known as Freon. Over the years, different types of refrigerant have been developed with some refrigerants being designed particularly for heat-pump systems.

A heat-pump has the ability to bring heat into a room or to take it out. In the air conditioning cycle, the evaporator absorbs heat from inside the house and rejects the heat outside through a condenser. The condenser is located outside the space being cooled and an evaporator is located inside the space being cooled. The key component that makes a heat pump different from air conditioner is the reversing valve. The reversing valve allows for the flow direction of the refrigerant to be changed. This allows the heat to be pumped either into the space being conditioned or outside of the space being conditioned.

In the heating mode, the outdoor coil becomes the evaporator while the indoor coil becomes the condenser. The condenser dissipates the heat received from the refrigerant due to the air flowing there through and into the space to be heated. With the refrigerant flowing in the heating mode, the evaporator (outdoor coil) is absorbing the heat from the air and moving it inside. Once the refrigerant accepts heat, it is compressed and then sent to the condenser (indoor coil). The indoor coil then gives off the heat to the air moving there through which in turn heats the room being conditioned.

In the cooling mode, the outdoor coil is now the condenser and the indoor coil is the evaporator. The indoor coil will absorb heat from the air moving there through which cools the air being delivered to the room being conditioned. The condenser takes the heat from the refrigerant and transfers the heat to the outdoor air.

Heat pumps are normally used in more temperate climates. The reason for use in temperate climates is due to the problem of the outdoor coil forming ice which blocks airflow during the heating cycle. To compensate for icing during colder weather, a heat pump will have to temporarily switch back into the regular air conditioning mode to de-ice the outdoor coil. Rather than having cold air being discharged inside the space to be heated, a heating coil is switched on to heat the air being delivered through the inside coil to the space to be heated.

In the past, heat pumps were basically used in central air conditioning systems. A few of the more expensive window air conditioning units had the heat pump function. However, prior window mounted heat pumps were expensive, and had a number of draw-backs that are satisfied with the present invention.

In a window air conditioning unit or a through the wall system, normally everything is contained within the single unit. The exception might be the thermostat could be located at a remote location within the room to be heated or cooled. Otherwise the indoor coil, outdoor coil, compressor, reversing valve, motors, fans and expansion valves are all contained within a unit. That unit which is powered by electricity, must have suitable controls for operation of the unit plus give good air distribution within the space to be heated or cooled. A feature which is highly undesirable is for the unit to "short cycle." "Short cycle" means a good portion of the discharged air inside of the room goes directly back into the return side of the unit. In the past, something has been needed to prevent short cycling, while at the same time ensuring that the indoor coil receives full air-flow there across to give the maximum heat transfer.

While louvers have been designed in the past to deliver air to the space to be heated or cooled and return air to the unit, many of the earlier systems were defective because the air would short cycle without delivering its desired maximum effect to the space to be conditioned. Also, the indoor coil would not get the maximum heat transfer because the return air would not be delivered equally across the indoor coil.

Other prior louver systems have resistance to airflow there across due to sharp edges or corners on the louvers. By having a more aerodynamic louver, better airflow can be achieved. Also, one of the problems that has existed in the past is the ability to adjust the louvers either up or down, or left or right, to give a good distribution of the conditioned air to the enclosed space.

SUMMARY OF THE INVENTION

It is an object of the present invention to provide a better louver system for an air condition and/or heat pump.

It is a further object of the present invention to provide a return airflow indoor coil of an air conditioner and/or heat pump that has uniform air distribution there across for maximum heat transfer.

It is still another object of the present invention to provide a new type of louver system that can be snapped into the bezel or grill of a room air conditioner and/or heat pump.

It is yet another object of the present invention to provide a louver system where the left and right louvers operate independently of the up and down louvers for discharging of conditioned air into the enclosed space.

It is still another object of the present invention to have a no circulation zone between the discharge louvers and the intake air return due to the curvature of the discharge louvers.

It is yet another object of the present invention to provide a pivot point about which the up and down louvers may pivot so that they operate uniformly.

It is another object of the present invention to have independent left and right directional louvers which are operating independently of each other and directing air being discharged inside of the conditioned space.

It is still another object of the present invention to provide a way to attach the bezel or the external shell thereof onto the room air conditioner and/or heat pump.

It is another object of the present invention to reduce noise of an air condition and/or heat pump as heard inside the room being conditioned.

It is yet another object of the present invention to reduce air flow turbulence within the air conditioner and/or heat pump to improve efficiency thereof.

DESCRIPTION OF THE PREFERRED EMBODIMENT

Figure 1:
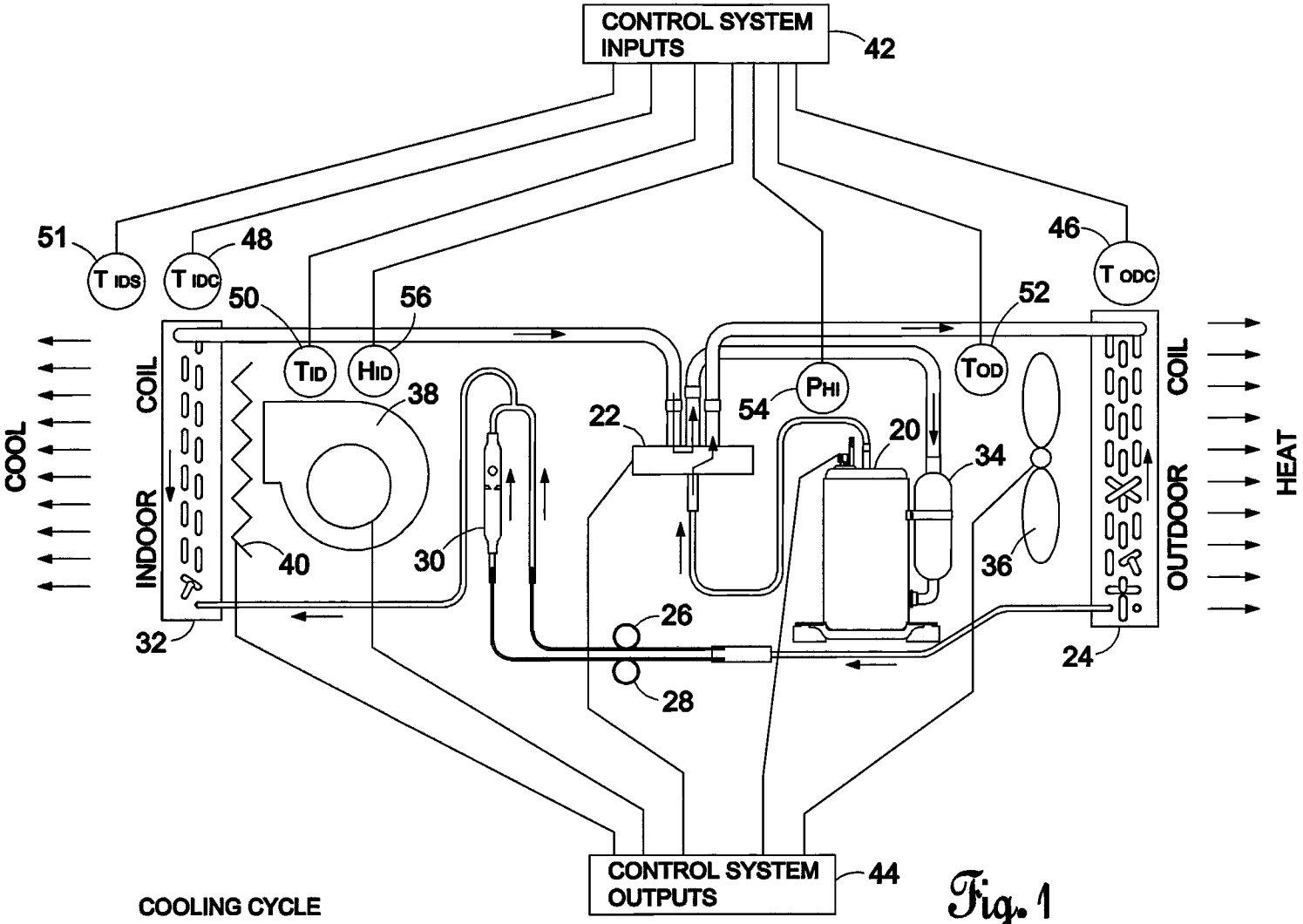
FIG. 1 is a schematic pictorial diagram of an air conditioner/heat pump made according to the present invention which is operating in the cooling cycle.

A combination room air conditioner/heat pump is pictorially illustrated in FIG. 1. A refrigerant is compressed inside of compressor 20 and flows there from in the direction indicated by the arrows through reversing valve 22. The refrigerant changes from the vapor state to the liquid state in outdoor coil 24. The outdoor coil 24 is acting as a condenser and is giving off heat to the air flowing there through.

From the outdoor coil 24 the refrigerant flows through heating/cooling capillary tube 26 and cooling capillary tube 28. From the cooling capillary tube the refrigerant flows through check valve 30. Both streams of the refrigerant are combined together and allowed to expand inside of indoor coil 32. The indoor coil 32 is functioning as an evaporator and is therefore absorbing heat from the air flowing there through to give a cooling effect. Inside of the indoor coil 32 the refrigerant is changing from a liquid to a vapor state.

From the indoor coil 32 the refrigerant flows through the reversing valve 22 in the directions indicated by the arrows to the accumulator 34.

Simultaneously, a fan 36 forces air through the outdoor coil 24 and a blower 38 directs air through the indoor coil 32. While not used in the cooling cycle, a heater coil 40 is located in the path of airflow through the indoor coil 32.

The controls for the air conditioner illustrated in FIG. 1 are for simplicity purposes divided between control system inputs 42 and control system outputs 44. A temperature sensor 46 is located on the outdoor coil 24 and is referred to as $T_{ODC}$. Likewise a temperature sensor 48 is mounted on the indoor coil 32 and is used to measure the temperature thereof and is referred to as $T_{IDC}$. The temperature sensor 51 is measuring the air as it comes out of the indoor coil 32 and is referred to as the temperature of the indoor supply $T_{IDS}$.

Located in the airstream of air coming into the air conditioner from the room being cooled is a temperature sensor 50, which measures the indoor temperature and is referred to as $T_{ID}$. Temperature sensor 50 ($T_{ID}$) is what is used to set the desired indoor temperature. Temperature sensor 52 is located in the airstream of the outdoor air being brought into the air conditioner and measures outdoor air temperature and is referred to as $T_{OD}$.

On the discharge side of the compressor 20 is a pressure sensor 54 which measures the high pressure $P_{HI}$ of the refrigerant being discharged from the compressor 20. The pressure sensor 54 may be used to shut the system down if extreme pressure is generated or something is not functioning properly.

An indoor humidity sensor 56 is also located in the path of the air being brought into the air conditioner to measure relative humidity and is also referred to as $H_{ID}$.

While not shown in the pictorial diagram of FIG. 1, the voltage level of the incoming line voltage is also measured so that if the voltage gets too high or too low, operation of the air conditioner will stop until line voltage gets back into normal levels. For example, in brown-out conditions the air conditioner would shut OFF.

Using the information collected from temperature sensors 46, 48, 50, 51 and 52, pressure sensor 54 and indoor humidity sensor 56, control system outputs 44 are generated. Control systems outputs 44 may control the speed of fan 36 and/or blower 38. The control of the speed may be ON, OFF, various set points, or may have an infinitely variable speed by using pulse width modulation. While the fan 36 and blower 38 may be driven by single motor, they may also be driven by separate motors which allows for independent variation of their respective speeds.

Also the control system output 44 controls the operation of the compressor 20 and the reversing valve 22. If extra heat is necessary during a heating cycle, heater coil 40 may be turned on as will be subsequently described.

Figure 2:
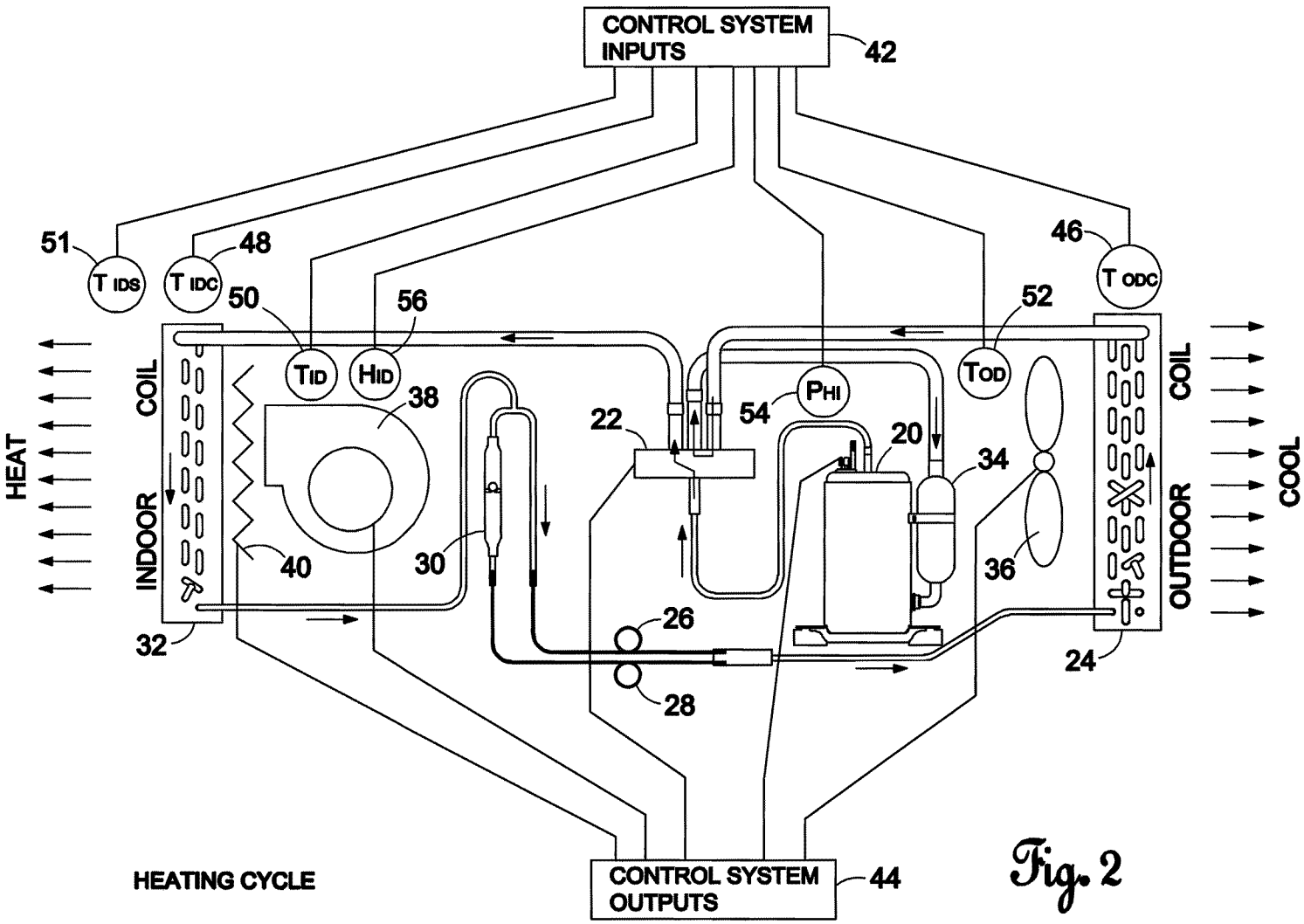
FIG. 2 is the same pictorial schematic diagram as shown in FIG. 1 except the air conditioner/heat pump is operating in the heating cycle.

As soon as the air conditioner as shown in FIG. 1 is switched from a cooling mode to a heating mode, it now functions as a heat pump, which is illustrated in FIG. 2. The control system outputs 44 are used to switch the reversing valve 22 to change the direction of flow of the refrigerant there through. When operating in the heating mode, the compressed gas changes to a liquid in the indoor coil 32, which is now acting as a condenser. As a result the indoor coil 32 now gives off heat to the air flowing there across. The flow of the liquid refrigerant from the indoor coil 32 cannot flow through the check valve 30 which closes. Therefore, the refrigerant only flows through the cooling/heating capillary tube 26. The restricted flow allows the refrigerant which is in a liquid state to expand inside of outdoor coil 24, which is now operating as an evaporator.

The outdoor coil 24 absorbs heat from the air flowing there across, therefore discharging cool air to the outside. The vapor in the outdoor coil 24 flows through the reversing valve 22 into the accumulator 34 of the compressor 20. The refrigerant is then compressed again and the cycle repeated.

During the heating cycle in cold weather, sometimes the outdoor coil 24 will freeze up. During those occasions it may be necessary to reverse cycle the unit to remove ice from the outdoor coil 24. When that occurs, the heater 40 is turned ON so that warm air will continue to flow into the room being heated. The speed of the fan 36 and the blower 38 may also be varied as is desired by the particular operation.

Figure 3:
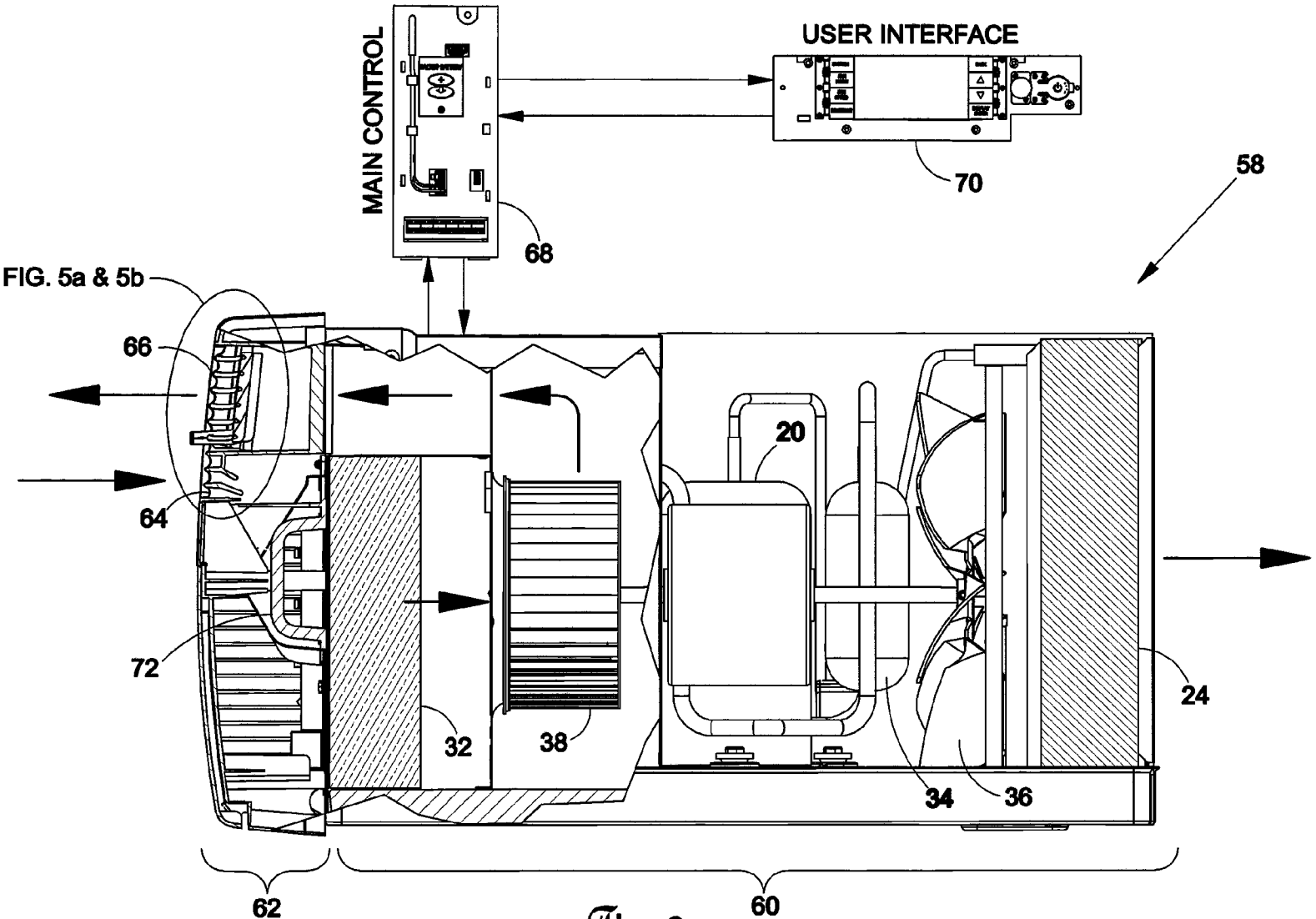
FIG. 3 is a side view of an air conditioner/heat pump with a partial cut-away to show internal components therein and an exploded view of the main control and user interface.

Referring now to FIG. 3, a typical air conditioner/heat pump 58 is shown with portions being broken away or exploded for illustration purposes. The air conditioning/heat pump unit 60 is illustrated by the portion within the bracket, which air conditioning/heat pump unit 60 has a bezel 62 on the front thereof. In the break away view of FIG. 3, internal components of the air conditioner/heat pump 58 can be seen, including the indoor coil 32 and outdoor coil 24 along with the fan 36 and blower 38. In the background the compressor 20 and accumulator 34 can also be seen.

Inside the bezel 62 are located front intake louvers 64 and horizontal discharge louvers 66 as will be explained in more detail subsequently. The arrows in the air conditioner/heat pump 58 illustrate the direction of movement of air there through. Outside air comes from the sides and can be seen in FIG. 4*a*.

Exploded from the air conditioner/heat pump 58 for display purposes is the main control 68 and the user interface 70. As will be explained in more detail subsequently, the main control 68 is located in the left hand side toward the front and the user interface 70 is located on the user interface mount 72.

Figure 4A:
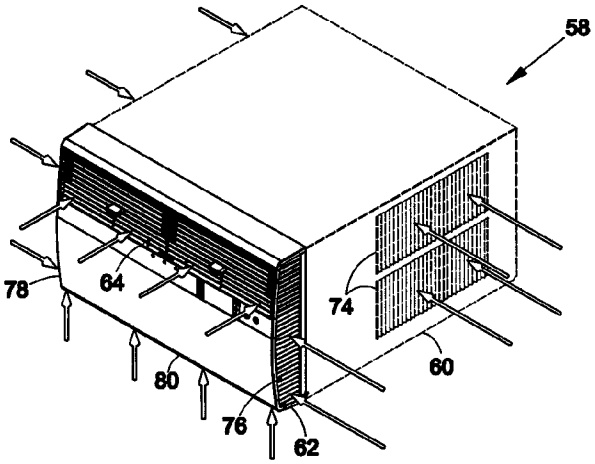
FIG. 4*a* is a perspective view of an air conditioner/heat pump made in accordance with the present invention with the arrows illustrating airflow into the unit.
Figure 4B:
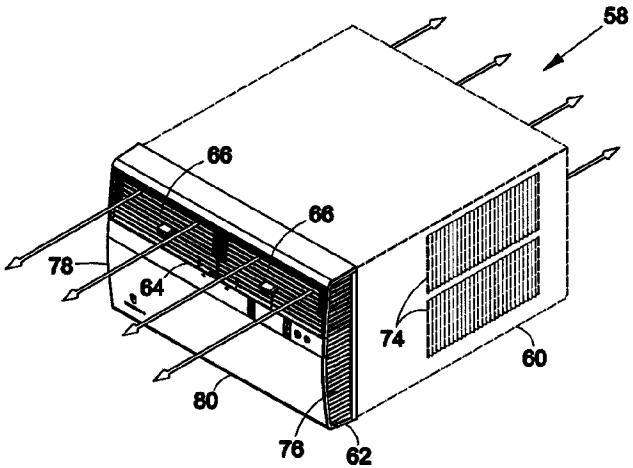
FIG. 4*b* is a perspective view of an air condition/heat pump made in accordance with the present invention with the arrows illustrating airflow out of the unit.

Referring to FIG. 4*a* and FIG. 4*b* in combination airflow into and out of the air condition/heat pump 58 is illustrated. In FIG. 4*a* air flows into the main air conditioning unit 60 through intake vents 74. Like intake vents 74 are also located on the opposing side of the main air conditioning unit 60. The air flowing in through the intake vents 74 is outside air.

Inside air is flowing into the bezel 62 though front intake louver 64 right side intake louver 76, left side louver 78 (not visible in FIG. 4*a*) and bottom intake louver 80 (not visible in FIG. 4*a*). In this manner, air enters from all sides and flows over the entire surface of the indoor coil 32 (not visible in FIG. 4*a*) for the maximum heat transfer therewith.

FIG. 4*b* illustrates the discharge air from the air conditioner/heat pump 58. Air discharged from the back thereof after flowing over the outdoor coil 24 is illustrated by the arrows extending from the rear of the main air conditioning unit 60. Flowing from the upper front of the bezel 62 through horizontal discharge louvers 66 is the conditioned air being delivered to the room to be either cooled or heated. While the illustration in FIG. 4*b* shows air being discharge straight in the room being cooled or heated, that will vary depending upon the position of the horizontal discharge louvers 66, plus the front left and right louvers 82 and 84 (not shown in FIG. 4*b*). A curve in the horizontal discharge louvers 66 as will be subsequently discussed, directs the discharged air upward.

Figure 5A:
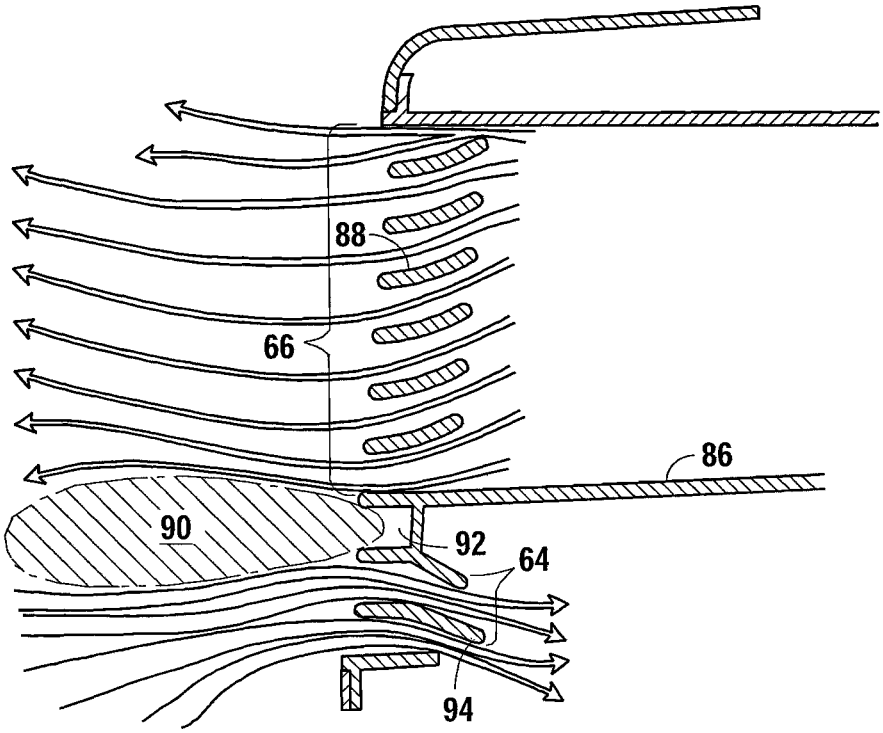
FIG. 5*a* is a cross-sectional view of a portion of FIG. 3 illustrating adjacent intake and discharge louvers with the discharge louvers being in a downward position and the arrows indicating general airflow.

Referring to FIGS. 5*a* and *b* in combination, the configuration of the front intake louvers 64 and the horizontal discharge louvers 66 are illustrated with the air flow there across. All of the louvers (64 and 66) are curved on the front and trailing ends thereof to minimize turbulences as air flows there across. The front air intake louvers 64 are stationary. However, the front intake louvers 64 directs the air as shown for distribution across the top part of the face of the indoor coil 34. With the front intake louvers 64 as shown in combination with right side intake louver 76, left side intake louver 78 and bottom intake louver 80, incoming air is distributed all across the indoor coil 32 for a maximum heat exchange therewith.

Baffle 86 prevents the intake air from mingling with the discharge air inside of the bezel 62. After the incoming air has flowed through the indoor coil 32 for maximum heat transfer therewith, through the blower 38 and is ready for discharge into the room being heated or cooled, horizontal discharged louvers 66 may be positioned in the upward or downward position, or any position therebetween. FIG. 5*a* illustrates downward position of horizontal discharge louvers 66. Each of the horizontal discharge louvers 66 has an inside radius of curvature 88. The inside radius of curvature 88 even when the horizontal discharge louvers 66 are in the downward position, will cause the air to flow upward as illustrated in FIG. 5*a*. Due to the upward discharge of air through the horizontal discharge louver 66, there is an area of no recirculation 90 and a no flow zone 92 between the horizontal discharge louver 66 and the front intake louvers 64. The no flow zone 92 and the area of no recirculation 90 prevents the room air conditioner/heat pump 58 from short cycling with conditioned air immediately going back in through the intake louvers. The inside radius curvature 88 of the horizontal discharge louvers 66 in combination with the no flow zone 92 is what prevents the short cycling of the air conditioner, especially when the front intake louvers 64 and the horizontal discharge louvers 66 are so close together. Also the velocity of the air being discharged across horizontal discharge louvers 66 is much greater than the velocity of the air coming in through the front intake louvers 64. However, by adding the front intake louvers 64, a much more complete distribution of intake air across the indoor coil 32 can be accomplished.

Figure 5B:
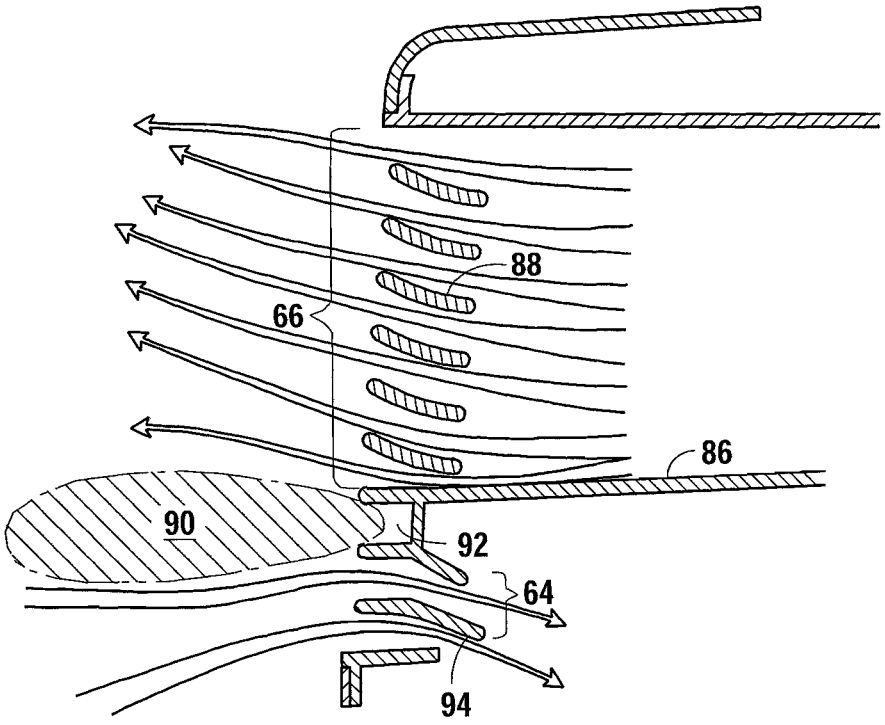
FIG. 5*b* is a cross-sectional view of a portion of FIG. 3 illustrating adjacent intake and discharge louvers with the discharge louvers being in an upward position with the arrows indicating general airflow.

Referring now to FIG. 5*b*, the horizontal discharge louvers 66 are turned upward so that as the air flows there across, the air is directed more in an upward direction than is shown in FIG. 5*a*. The directing of the horizontal discharge louvers 66 in the upward direction creates an even larger area of no recirculation 90 in front of the no flow zone 92. Therefore, when the horizontal discharge louvers 66 are in the position as illustrated in FIG. 5*b*, the area of no recirculation 90 is even larger and there is an even less likelihood of short cycling. Again, the baffle 86 prevents intake air from mingling with the discharge air inside of the bezel 62. The downward direction 94 of the front intake louver 64 insures a complete distribution of the air over the upper portion of the indoor coil 32.

Figures 6A, 6B, 6C:
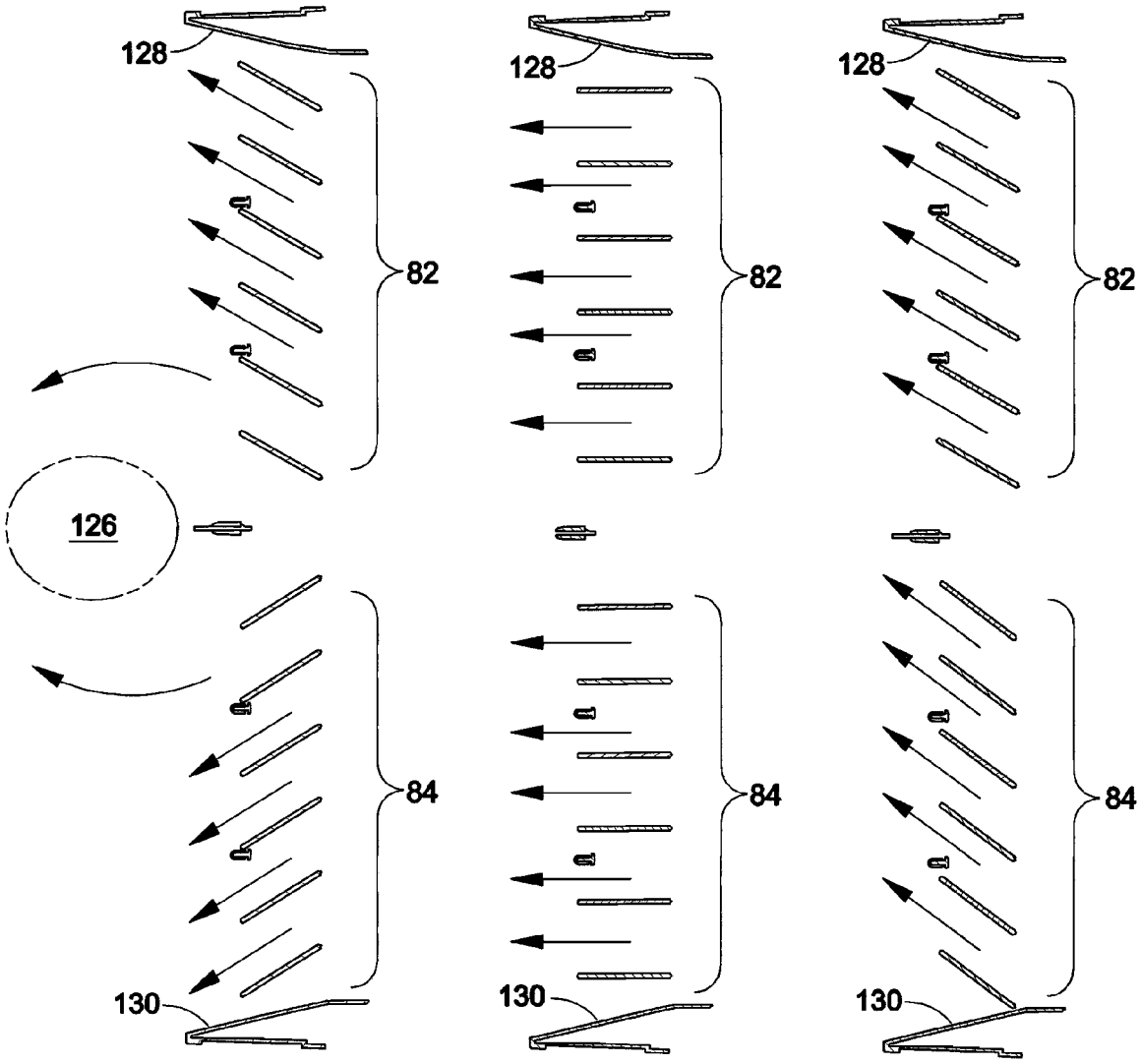
FIG. 6*a* is a cross-sectional view of FIG. 9*a* along section lines 6-6 with the left and right discharge louvers discharging outwardly.
FIG. 6*b* is a cross-sectional view of FIG. 9*a* along section lines 6-6 with the left and right discharge louvers discharging straight ahead.
FIG. 6*c* is a cross-sectional view of FIG. 9*a* along section lines 6-6 with the left and right discharge louvers discharging to the left.
Figure 6D:
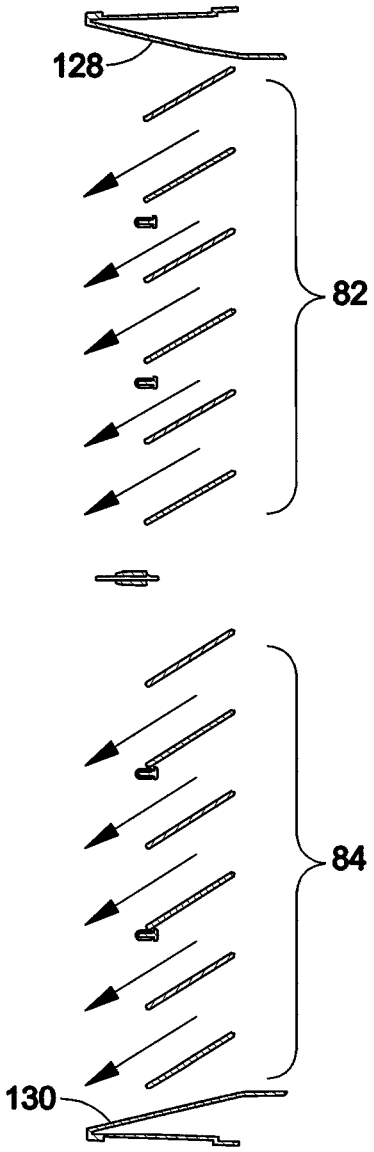
FIG. 6*d* is a cross-sectional view of FIG. 9*a* along section lines 6-6 with the left and right discharge louvers discharging to the right.
Figure 6E:
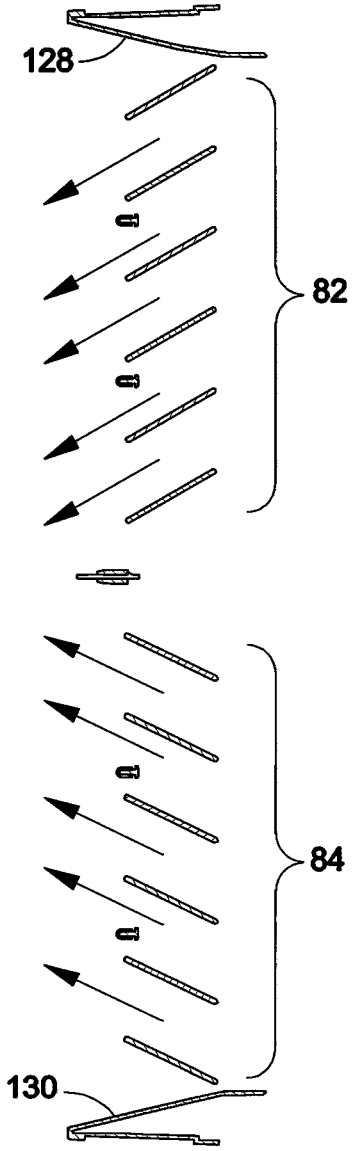
FIG. 6*e* is a cross-sectional view of FIG. 9*a* along section line 6-6 with the left right discharge louvers discharging towards the center.
Figure 7:
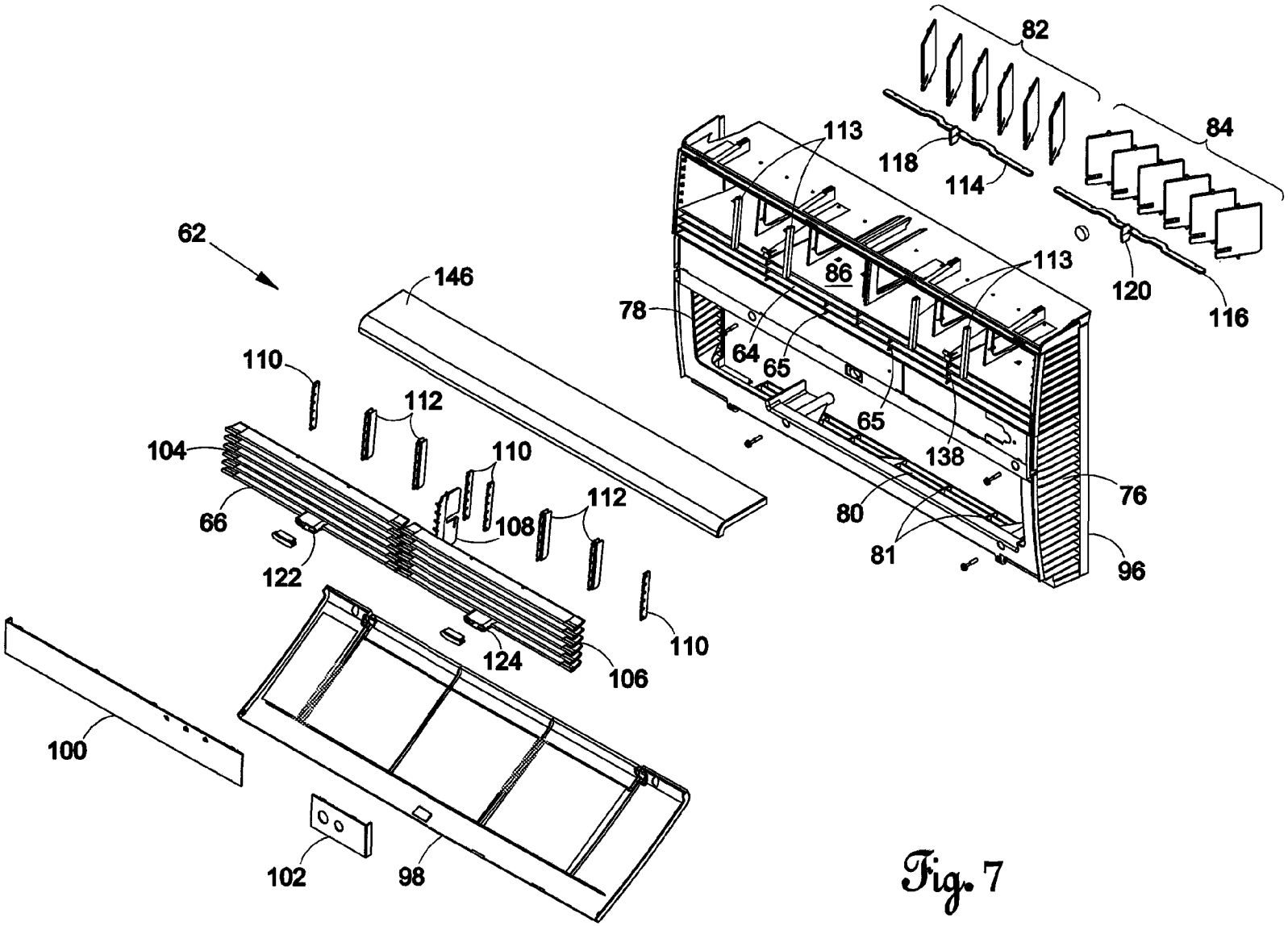
FIG. 7 is an exploded perspective view of the bezel.

Skipping FIG. 6*a* through *e* for the moment, an exploded perspective of the bezel 62 is shown in FIG. 7. A bezel frame 96 has the right side intake louvers 76, left side intake louvers 78, bottom intake louver 80, and front intake louver 64 mounted therein. Baffle 86 separates the incoming air from the air to be discharge through the bezel 62. A lower hinged door 98 provides access to a filter (not shown) in the lower part of bezel 62. Immediately above the lower hinged door 98, is a decorative left face plate 100 and a right face place 102, located on either side of the user interface 70 (see FIG. 3).

Immediately above the front intake louvers 64 and baffle 86 are the horizontal discharge louvers 66. The horizontal discharge louvers 66 have a left side 104 and the right side 106 that are connected through a central support post 108. Clip brackets 110 are located on either end of the left side 104 and right side 106 of the horizontal discharge louvers 66 to give the louvers 66 structural support. Adjustment posts 112 provide structural support during the up and down positioning of horizontal discharge louvers 66. Adjustment posts 112 are channel shaped and wrap around felt covered posts 113. The felt covered posts 113 provide friction contact for smooth up and down positioning of the horizontal discharge louvers 66.

Located behind the horizontal discharge louvers 66 is the left vertical discharge louvers 82 and the right vertical discharge louvers 84. Connecting the left vertical discharge louvers 82 together is left connecting rod 114 while right connecting rod 116 connects together the right discharge louvers 84. Left tab 118 on the left connecting rod 114 feeds through the bezel frame 96 to connect to left adjusting handle 122. Right tab 120 connects to the right connecting rod 116 and feeds through the bezel frame 96 to connect to the right adjusting handle 124.

By adjusting left adjusting handle 122, up or down, the left side 104 of the horizontal discharge louvers 66 are likewise adjusted up or down. By adjusting the left adjusting handle 122 left or right, left vertical discharge louvers 82 are adjusted left or right via left tab 118 and left connecting rod 114. By the adjusting of right adjusting handle 124 up or down, the right side 106 of horizontal discharge louvers 66 are adjusted up or down. Likewise by adjusting right adjusting handle 124 left or right, right vertical discharge louvers 84 are adjusted left or right via right tab 120 and right connecting rod 116.

Going back to FIG. 6*a* through 6*e*, sequential views of the various positions of the left vertical discharge louvers 82 and the right vertical discharge louvers 84 are shown with their effects on air current being illustrated by the arrows. The cross sectional views shown pictorially in FIGS. 6*a* through 6*e* are taken along section lines 6-6 of FIG. 9*a*, but with the vertical discharge louvers 82 and 84 being shown in different positions in each view. In FIG. 6*a* the left vertical discharge louvers 82 are adjusted to the left and the right vertical discharge louvers 84 are adjusted to the right. While the air generally flows in the direction indicated by the arrows, there is a dead zone 126 directly in front of the air conditioner/heat pump 58. A person can stand directly in front of the air conditioner/heat pump 58 and receive very little air flow with the vertical discharge louvers 82 and 84 adjusted as shown in FIG. 6*a*. This allows for room circulation without overcooling or chilling the room. A left side panel 128 and a right side panel 130 helps direct the air through the louvers vertical discharge 82 and 84.

Referring to the sequential view as shown in FIG. 6*b*, both the left vertical discharge louver 82 and the right vertical discharge louver 84 are positioned to direct the air straight ahead, as is represented by the arrows.

In the sequential view as shown in FIG. 6*c* both the left vertical discharge louvers 82 and the right vertical discharge louvers 84 are positioned to direct the air flow there through to the left as is illustrated by the arrows. In the sequential view as shown in FIG. 6*d*, both the left vertical discharge louver 82 and the right vertical discharge louver 84 are adjusted to direct the air flowing there through to the right as indicated in the direction of the arrows. Lastly, if cooling is desired to be focused at a point in the center, the vertical discharge louvers 82 and 84 can be adjusted as shown in FIG. 6*e* to direct the air towards the center. This last sequential view as shown in FIG. 6*e* will cause a turbulence in the middle and is not ideal for cooling the entire room. The vertical discharge louvers 82 and 84 can be adjusted to full left, full right, or any variation therebetween, the adjustments being independent of each other to create an infinite number of air flow patterns.

By the design as shown, the left side 104 and right side 106 of the horizontal discharge louvers 66 to operate independently of the left vertical discharge louver 82 and the right vertical discharge louver 84. This gives the maximum amount of control of the air being discharged into the room being heated or cooled.

Also by use of the horizontal discharge louvers 66 which have an inside radius of curvature 88, the left vertical discharge louvers 82 and right vertical discharge louvers 84 are less visible. Being less visible, the "wall eyed" effect of the left vertical discharge louver 82 and the right vertically discharge louver 84 being independently adjustable is practically eliminated.

Another side benefit of the inside radius of curvature 88 of the horizontal discharge louvers 66 and the front intake louvers 64 as shown in combination with right side intake louver 76, left side intake louver, 78 and bottom intake louver 80, is the reduction in sound of the air conditioner/heat pump 58. Because there is not a straight discharge of conditioned air or intake air, and sound travels in a straight line until reflected, the internal sound of the air conditioner/heat pump 58 has to be reflected before it is heard. This results in an attenuation of the sound.

Figure 8B:
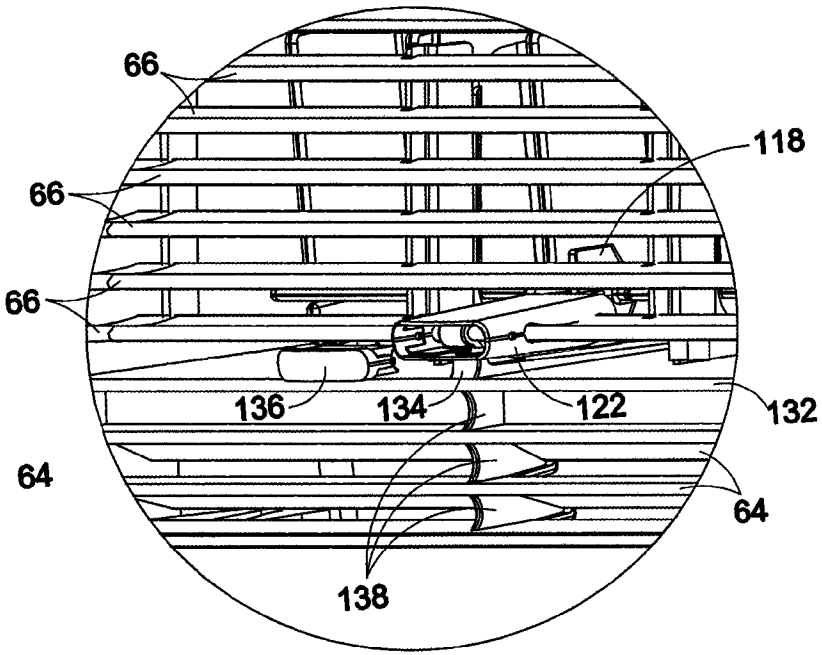
FIG. 8*b* is an enlarged detailed view of the adjustment feature of the up/down discharge louver shown in FIG. 8*a*.
Figure 8A:
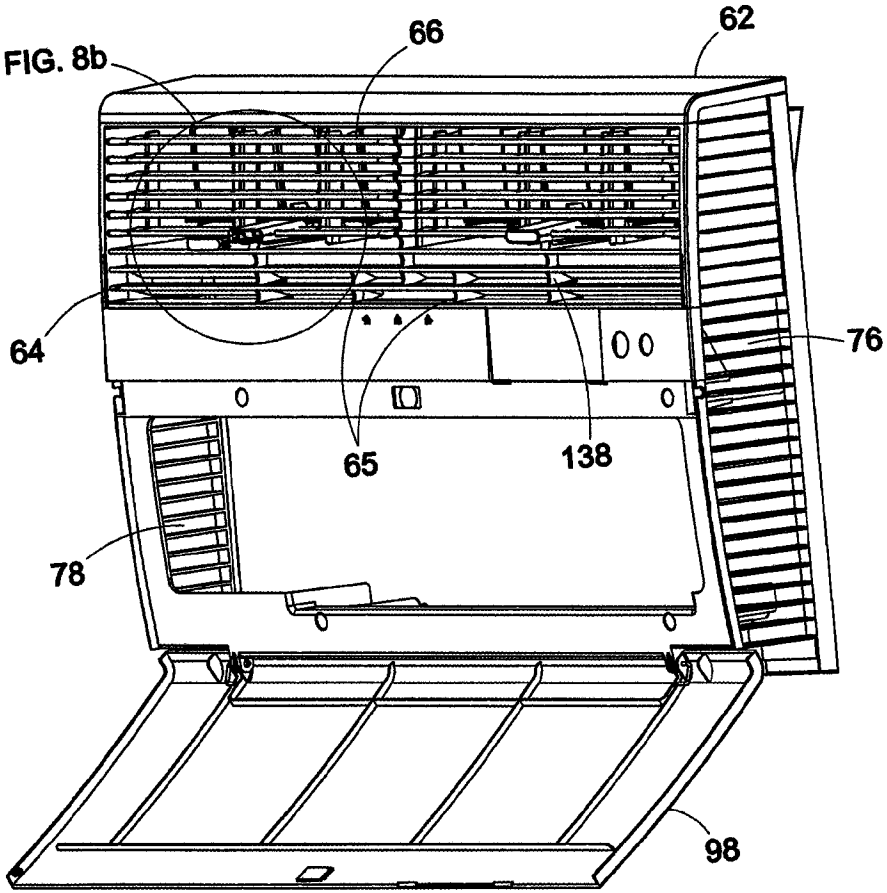
FIG. 8*a* is a front view of the bezel or grill with the front door open.

Referring to FIGS. 8*a* and 8*b* in combination, a perspective view is shown of the bezel 62 with the lower hinged door 98 being open. The feature of interest is the left adjusting handle 122 which is shown in more detail in the enlarged view FIG. 8*b*. The left adjusting handle 122 clamps over the lower most of the horizontal discharge louvers 66. Mounted on a ridged cross member 132 that does not move or pivot is an anchor clip 134. Anchor clip 134 extends upward into left adjusting handle 122 and clips on the front edge of the lower most horizontal discharge louver 66. A slot in the bottom of the left adjusting handle 122 allows some left to right movement of the left adjusting handle 122 on the anchor clip 134. To hold the left adjusting handle 122 into position on the anchor clip 134, a cap 136 is inserted therein. The cap 136 simply snaps into position.

By having the left adjusting handle 122 rigidly connected to the anchor clip 134, all of the horizontal discharge louvers 66 will adjust up or down uniformly without warping. Simultaneously, the rear of the left adjusting handle 122 is connected to the left tab 118 of the left connecting rod 114 (see FIG. 7). Hence, by adjusting the left adjusting handle 122 to the left or right, due to the slot in the bottom thereof allowing some movement to the left or right on anchor clip 134, the left vertical discharge louvers 82 (see FIG. 7) are adjusted to the left or right.

Figure 10B:
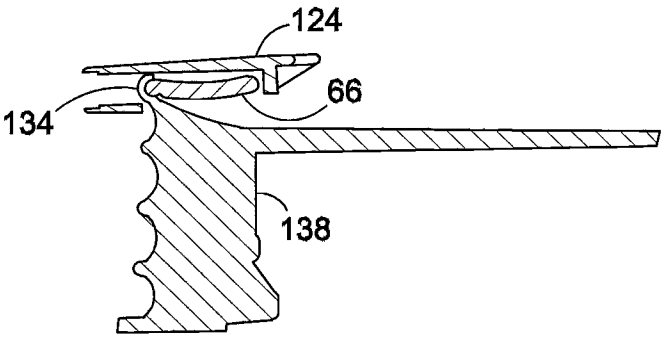
FIG. 10*b* is an enlarged cross-sectional view of FIG. 10*a* along Section lines 10*b*-10*b*.
Figure 10A:
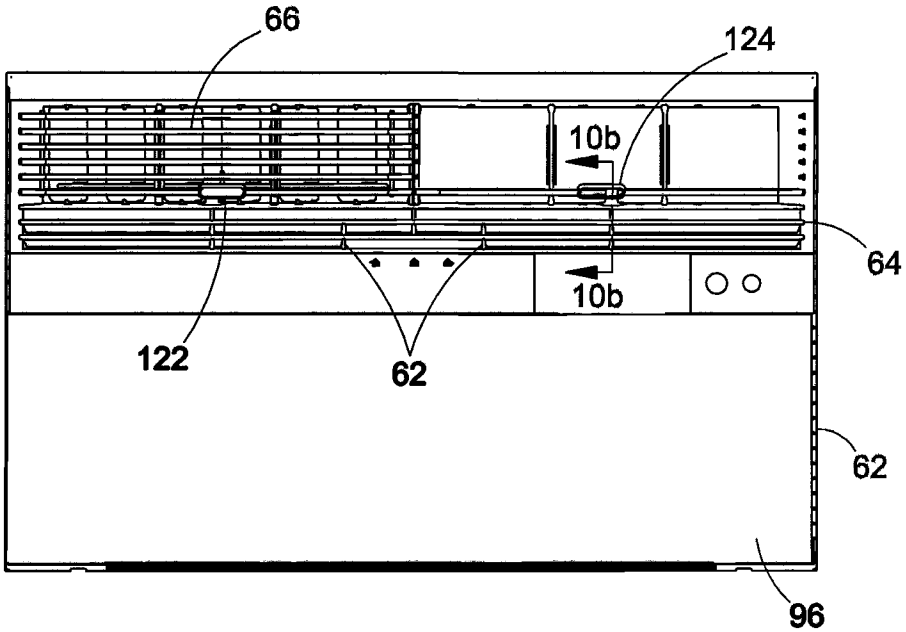
FIG. 10*a* is a front view of the bezel with the right side up/down discharge louver being removed for illustration purposes.

Referring to FIG. 10*a* and FIG. 10*b* in combination, FIG. 10*a* shows a front view of the bezel 62, but with the right side of the horizontal discharge louvers 66 being removed. The left side of the horizontal discharge louvers 66 remained in place as well as the front intake louvers 64. By taking an enlarged cross sectional view along section lines 10*b*-10*b* of FIG. 10 *a*, the anchor clip 134 can be seen in more detail. Anchor clip 134 clips into the lower most horizontal discharge louver 66 and is contained inside of right adjusting handle 124. The right adjusting handle 124 is identical to the left adjusting handle 122 as well as the louvers connected thereto. The anchor clip 134 is formed as part of the anchor bar 138. Anchor bar 138 may be molded and made integral with the bezel frame 96 (see FIGS. 8*a* and 8*b*).

Referring to FIGS. 7, 8*a* and 10*a* in combination, the bezel frame 96 has vertical posts 65 in front intake louvers 64 and horizontal connectors 81 in bottom intake louvers 80 to provide a structured web for additional strength.

Figure 11B:
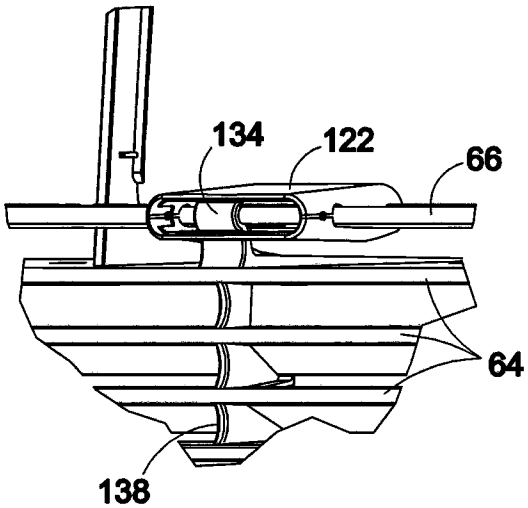
FIG. 11*b* is an enlarged view of the adjustment feature of the discharge louvers shown in FIG. 11*a*.
Figure 11A:
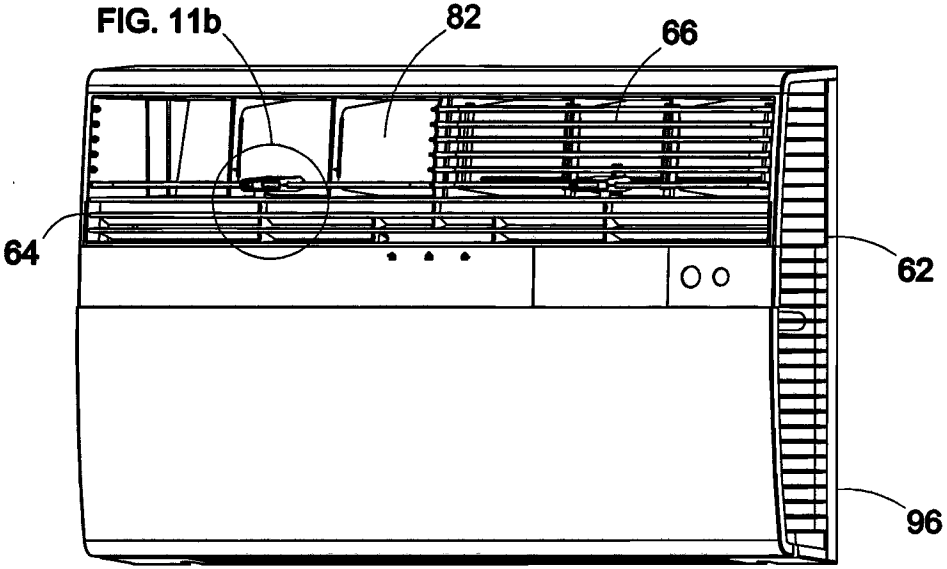
FIG. 11*a* is a front view of the bezel with the left side up/down discharge louvers being removed for illustration purposes.

FIGS. 11*a* and 11*b* will be explained in combination. FIG. 11*a* is a perspective view of the bezel 62, but with the horizontal discharge louvers 66 on the left side 104 being removed to better illustrate the left adjusting handle 122. An enlarged partial exploded view shows the left adjusting handle 122 clamped on a lower most horizontal discharge louver 66 on the left side. Clipped to the front of the lower horizontal discharge louver 66 is the anchor clip 134. Below the anchor clip 134 is shown the anchor bar 138 which is rigidly connected to and formed with the front intake louvers 64.

Figure 9B:
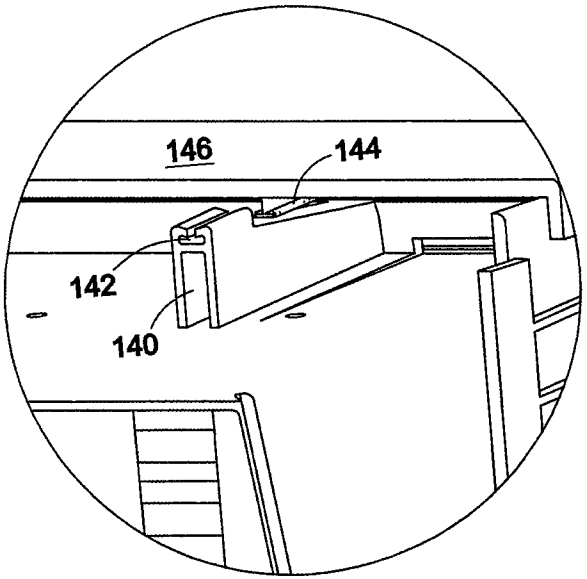
FIG. 9*b* is an enlarged detail of the alignment connection feature of the bezel shown in FIG. 9*a*.
Figure 9A:
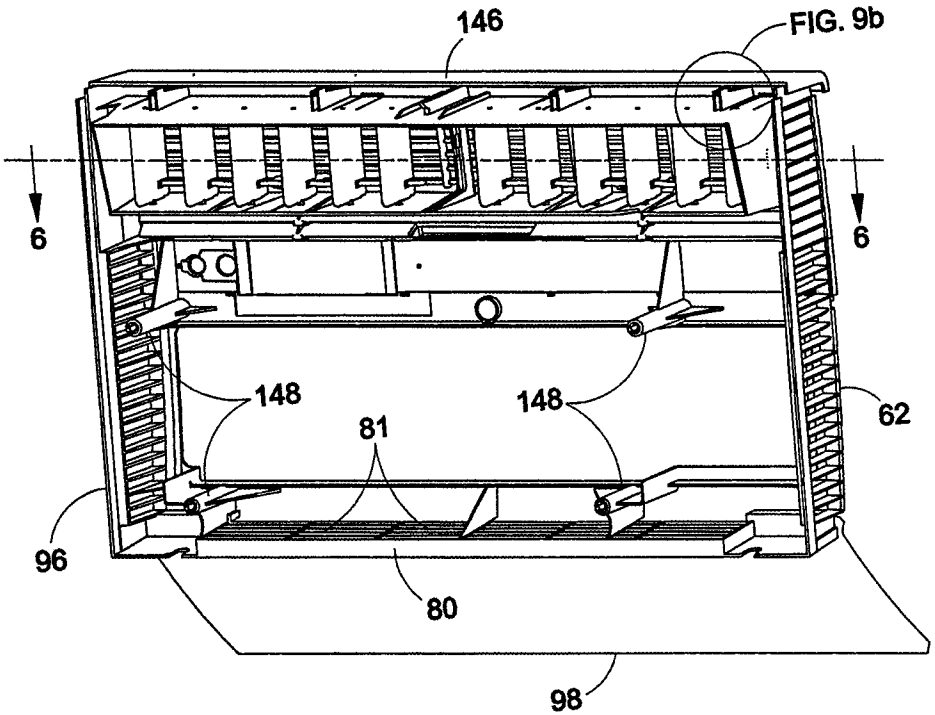
FIG. 9*a* is a back view of the bezel or grill with the front door open.

Referring now to FIGS. 9*a* and 9*b* in combination, in FIG. 9*a* a back side perspective view of the bezel 62 is shown with the lower hinged front door 98 being open. The feature enlarged in FIG. 9*b* from FIG. 9*a* shows a lower channel 140 formed integral with the bezel frame 96. The lower channel 140 receives projections (not shown) from the main body of the air conditioner/heat pump 58 to align the bezel 62 thereon. Above the lower channel 140 is located an upper channel 142 that is designed to receive a T-connector 144. The T-connector 144 is mounted on the underside of the top 146 of the bezel 62. In this manner if someone wishes to change the color of the top 146 of the bezel 62 they may do so by simply sliding the T-connector out of the upper channel 142. Likewise the lower hinged front door 98 may be changed to change the color to match the top 146. In that manner, colors may be changed and matched as desired by the top 146 and/or lower hinged front door 98. The top 146 is shown more clearly in the exploded perspective view of FIG. 7.

Also, in FIG. 9*a*, alignment posts 148 are provided as part of the bezel frame 96 to help align the bezel 62 on the air conditioner/heat pump 58. The upper two of alignment posts 148 extend through and help align the user interface mount 72 into position. See FIG. 3. The user interface 70 is mounted on the right side of the user interface mount 72.

What we claim is:

1. A method of assembly and operation of a room air conditioner or heat pump unit having a compressor for compressing a refrigerant, an indoor coil for receiving said refrigerant there through, an outdoor coil for receiving said refrigerant there through, an accumulator on an intake side of said compressor, either of said indoor coil or said outdoor coil being an evaporator and the other being a condenser of said refrigerant, a fan for directing air through said outdoor coil, a blower for directing air through said indoor coil, the method comprising the following steps:

taking air into said unit through intake louvers on a front of a bezel as well as sides and bottom thereof to allow maximum heat exchange between air flowing through said indoor coil and said refrigerant;

discharging conditioned air from said unit through parallel discharge louvers on a front of said bezel, said parallel discharge louvers being located above said intake louvers on said front of said bezel, said parallel discharge louvers having a concave upper surface which directs air upward to prevent short cycling;

first directing said discharged conditioned air to a left or right on each side thereof;

second directing said discharged conditioned air up or down on each side thereof; and said first and second directing steps being controlled by an adjusting handle on each side thereof, connecting said adjusting handle to a pivotable, slideable clip;

spacing said parallel discharge louvers on said front of said bezel a distance above said intake louvers to create a dead zone there between;

the method further including:

(a) clipping anchor bars onto said parallel discharge louvers said anchor bars holding adjusting handles for said first directing or said second directing steps;

(b) attaching connecting rods to said adjusting handles for moving vertical discharge louvers in said first directing step;

(c) smoothly positioning said adjusting handles on felt covered adjustment posts for moving said parallel discharge louvers during said second directing step;

(d) aligning posts of said bezel on said air conditioner or heat pump unit with alignment posts; and (e) interchanging colors of said bezel with an interchangeable front door and top of said bezel.

2. The method as recited in claim 1 including a further step of rounding leading or trailing edges of said louvers to decrease air turbulence there through.

* * * * *